US006986448B2

(12) United States Patent
Lat et al.

(10) Patent No.: US 6,986,448 B2
(45) Date of Patent: Jan. 17, 2006

(54) FASTENER DRIVING TOOL FOR SPACING OBJECT FROM SUBSTRATE

(75) Inventors: Geronimo E. Lat, Ivanhoe, IL (US); Joseph Righter, Jr., Rolling Meadows, IL (US); Francis D. O'Connor, Skokie, IL (US)

(73) Assignee: Illinois Tool Works Inc., Glenview, IL (US)

( * ) Notice: Subject to any disclaimer, the term of this patent is extended or adjusted under 35 U.S.C. 154(b) by 324 days.

(21) Appl. No.: 10/658,047

(22) Filed: Sep. 9, 2003

(65) Prior Publication Data

US 2005/0050712 A1 Mar. 10, 2005

(51) Int. Cl.
*B25C 1/04* (2006.01)

(52) U.S. Cl. ..... 227/83; 227/124

(58) Field of Classification Search ..... 227/30, 227/31, 119, 120, 123, 154, 155, 108, 140, 227/32, 124
See application file for complete search history.

(56) References Cited

U.S. PATENT DOCUMENTS

| | | | | | |
|---|---|---|---|---|---|
| 1,703,560 | A | * | 2/1929 | Voight | 52/680 |
| 1,816,387 | A | | 7/1931 | Menninger | |
| 2,589,481 | A | | 3/1952 | Goodstein | |
| 3,042,924 | A | * | 7/1962 | Frostad | 227/120 |
| 3,144,655 | A | | 8/1964 | Kent | |
| 3,279,672 | A | | 10/1966 | McKee | |
| 3,339,265 | A | * | 9/1967 | Powers et al. | 29/432.1 |
| 3,741,068 | A | | 6/1973 | Andruskiewicz | |
| 3,915,366 | A | * | 10/1975 | Mitchell | 227/83 |
| 4,496,090 | A | * | 1/1985 | Crevier et al. | 227/19 |
| 5,074,453 | A | | 12/1991 | Tachihara et al. | |
| 5,484,094 | A | | 1/1996 | Gupta | |
| 5,817,109 | A | * | 10/1998 | McGarry et al. | 606/143 |
| 6,113,332 | A | * | 9/2000 | Hill | 411/473 |
| 6,237,827 | B1 | | 5/2001 | Reckelhoff | |
| 6,363,679 | B1 | | 4/2002 | Rutherford | |
| 6,481,613 | B1 | | 11/2002 | Tebo | |
| 6,918,222 | B2 | * | 7/2005 | Lat et al. | 52/680 |
| 2003/0192935 | A1 | | 10/2003 | Lat et al. | |

FOREIGN PATENT DOCUMENTS

| | | |
|---|---|---|
| EP | 0 314 831 | 5/1989 |

* cited by examiner

*Primary Examiner*—Scott A. Smith
(74) *Attorney, Agent, or Firm*—Lisa M. Soltis; Mark W. Croll; Beem Patent Law Firm

(57) ABSTRACT

A novel nosepiece for a fastener driving tool for driving fasteners for holding and spacing an object at a predetermined distance from a substrate are provided, wherein the fastener driving tool has a housing, a driver blade within the housing for driving the fasteners, and a power source for driving the driver blade, and each of the fasteners includes a bridge portion, a first prong extending in a driving direction from the bridge portion, a second prong spaced from the first prong and extending generally parallel thereto in the driving direction from the bridge portion, wherein the second prong is substantially shorter than the first prong, the nosepiece comprising, a trailing end coupled to the housing of the fastener driving tool, a substrate contacting end, a channel for axially guiding the driver blade and the fastener in a driving direction toward the substrate, a slot proximate the substrate contacting end laterally extending into the channel for receiving the object, and a curved ramp within the channel, wherein a portion of the ramp is positioned between the slot and the substrate contacting end, the ramp being for interfering with the path of the second prong to bend the second prong toward the first prong to hold the object between the second prong and the bridge portion.

7 Claims, 4 Drawing Sheets

FASTENER DRIVING TOOL FOR SPACING OBJECT FROM SUBSTRATE

BACKGROUND OF THE INVENTION

1. Field of the Invention

The present invention is directed to a fastener driving tool for holding and spacing an object at a predetermined distance from a substrate.

2. Description of the Related Art

Several construction-related applications require an object to be spaced from a substrate. For example, before applying stucco to a substrate, it is usually necessary to space a sheet of wire lath from the substrate to reinforce the stucco.

Prior methods of spacing wire lath having included using nails with a cardboard spacer wrapped around the shank of each nail wherein the cardboard spacer has a thickness that corresponds to the desired space between the wire lath and the substrate so that when the wire lath is clamped between the cardboard spacer and the head of the nail, the lath is spaced from the substrate by the desired distance. However the installation of these nails spacers is labor intensive and time consuming, requiring each nail to be hammered into the substrate while the installer holds the wire lath between the cardboard spacer and the nail head. Further, it is possible that the wire lath will not be securely fastened between the nail head and the spacer. U.S. Pat. No. 6,363,679 discloses a similar means for spacing wire lath from a substrate using a screw and a plastic spacer. However, the screw and plastic spacer do not relieve the tedious and time consuming process of installing a plurality of screws in order to secure and space a sheet of wire lath at a distance from a substrate.

Staple driving tools have been used for fastening objects to substrates, however, they are generally unable to leave a space between the objects and the substrates. Examples of staple driving tools include model number 3150-S16 and model number IM200-S16 tools manufactured by Paslode, an Illinois Tool Works company.

Tools have also been designed for bending or shaping a fastener as it is being installed. See for example the U.S. patent application Ser. No. 10/119,597 and application Ser. No. 10/424,515, assigned to the assignee of this application, which discloses a deformation portion of the tool that deforms a portion of the fastener to provide a clamping force on a workpiece. However, the tool does not teach leaving a space between the workpiece and the substrate.

U.S. Pat. No. 5,484,094, assigned to the assignee of this application, discloses a tool for attaching metal lath to building substrates, but does not teach a tool that spaces the wire lath from the substrate.

U.S. Pat. No. 6,237,827 discloses a staple driving tool for clamping together two or more workpieces, however, this tool does not teach spacing one workpiece from the other.

What is needed is a tool for holding and spacing an object from a substrate quickly and securely that overcomes the problems of the prior art.

BRIEF SUMMARY OF THE INVENTION

A novel nosepiece is provided for a fastener driving tool for driving fasteners for holding and spacing an object at a predetermined distance from a substrate, the fastener driving tool having a housing, a driver blade within the housing for driving the fasteners, and a power source for driving the driver blade, each of the fasteners including a bridge portion, a first prong extending in a driving direction from the bridge portion, a second prong spaced from the first prong and extending generally parallel thereto in the driving direction from the bridge portion, wherein the second prong is substantially shorter than the first prong, the nosepiece including a trailing end coupled to the housing of the fastener driving tool, a substrate contacting end, a channel for axially guiding the driver blade and the fastener in a driving direction toward the substrate, a slot proximate the substrate contacting end laterally extending into the channel for receiving the object, and a curved ramp within the channel, wherein a portion of the ramp is positioned between the slot and the substrate contacting end, the ramp being for interfering with the path of the second prong to bend the second prong toward the first prong to hold the object between the second prong and the bridge portion.

A novel fastener driving tool is provided for driving fasteners for holding and spacing an object at a predetermined distance from a substrate, each of the fasteners including a bridge portion, a first prong extending in a driving direction from the bridge portion, a second prong spaced from the first prong and extending generally parallel thereto in the driving direction from the bridge portion, wherein the second prong is substantially shorter than the first prong, the fastener driving tool including a housing, a driver blade within the housing for driving the fastener in the driving direction, a power source for driving the driver blade, and a nosepiece having a trailing end coupled to the housing, a substrate contacting end, a channel for axially guiding the driver blade and the fastener in the driving direction toward the substrate, a slot proximate the substrate contacting end laterally extending into the channel for receiving the object, and a curved ramp within the channel, wherein a portion of the ramp is positioned between the slot and the substrate contacting end, the ramp being for interfering with the path of the second prong to bend the second prong toward the first prong to hold the object between the second prong and the bridge portion.

In one embodiment, a novel fastener driving tool is provided for driving fasteners for holding and spacing an object at a predetermined distance from a substrate, each of the fasteners including a bridge portion, a first prong extending in a driving direction from the bridge portion, a second prong spaced from the first prong and extending generally parallel thereto in the driving direction from the bridge portion, wherein the second prong is substantially shorter than the first prong, the fastener driving tool including a housing, a driver blade within the housing for driving the fastener in the driving direction, a power source for driving the driver blade, and a nosepiece having a first piece with a trailing end coupled to the housing and a substrate contacting end, a second piece having a trailing end pivotally coupled to the housing proximate to the trailing end of the first piece and a substrate contacting end, wherein the second piece is pivotable between a closed position wherein the second piece is adjacent to the first piece and an open position wherein the second piece is angled with respect to the first piece, a channel between the first piece and the second piece when the second piece is in the closed position for axially guiding the driver blade and the fastener in the driving direction toward the substrate, wherein the first piece and the second piece each include a slot proximate the substrate contacting ends of the pieces laterally extending into the channel, wherein the slots are aligned with one another when the second piece is in the closed position so that the slots form a path for the object, wherein one of the pieces includes a curved ramp positioned within the channel, a portion of the ramp being between the slot of the one of the pieces and the substrate contacting end of the one of the pieces, wherein the ramp is concave with respect to the slots for bending the second prong of the fastener toward the first prong to hold the object between the second prong and the bridge portion.

A novel method of holding and spacing an object at a predetermined distance from a substrate is also provided comprising the steps of providing a fastener having a bridge portion, a first prong extending in a driving direction from the bridge portion, a second prong spaced from the first prong and extending generally parallel thereto in the driving direction from the bridge portion, wherein the second prong is substantially shorter than the first prong, positioning the object proximate to the substrate, driving the fastener so that the first prong is driven into the substrate to a predetermined depth and so that the object is between the prongs, bending the second prong toward the first prong, holding the object between the second prong and the bridge portion so that the object is spaced from the substrate by the predetermined distance.

These and other features and advantages are evident from the following description of the present invention, with reference to the accompanying drawings.

DETAILED DESCRIPTION OF THE INVENTION

Figure 1D:
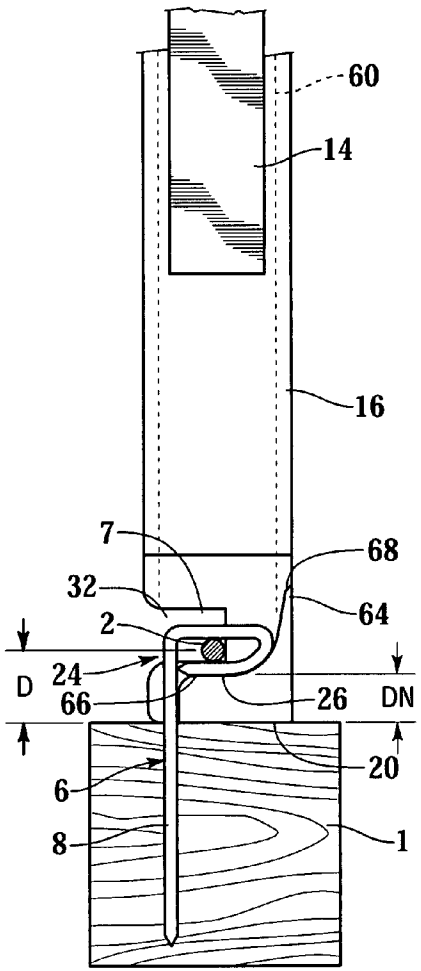
FIG. 1 is a side sectional view showing the progress of a fastener being installed by a fastener driving tool of the present invention to hold and space wire lath at a predetermined distance from a substrate.
Figure 1C:
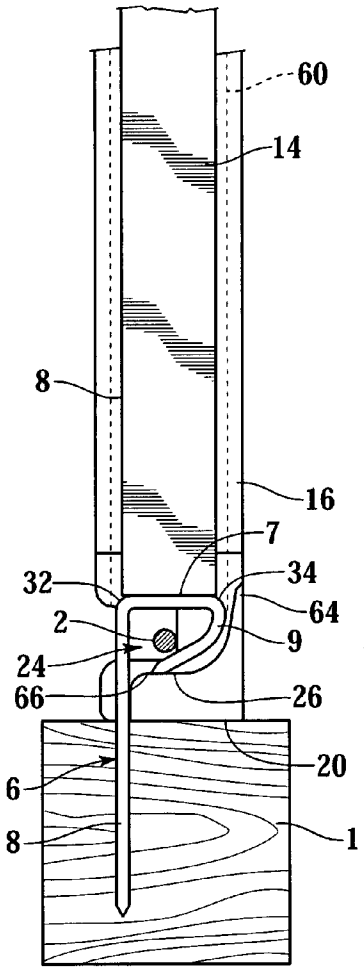
Figure 1B:
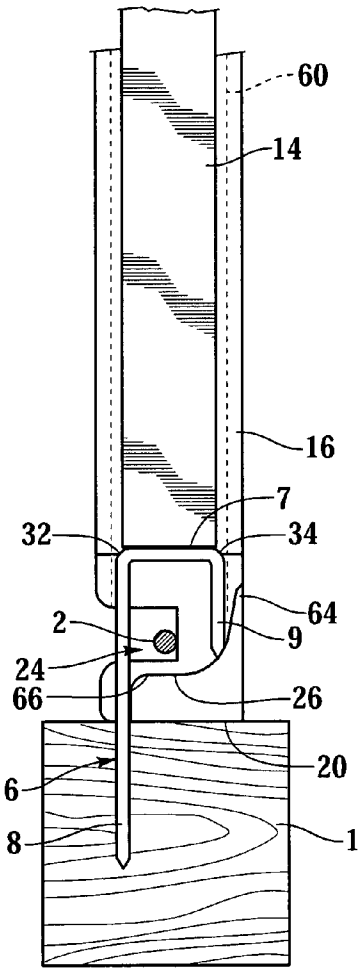
Figure 1A:
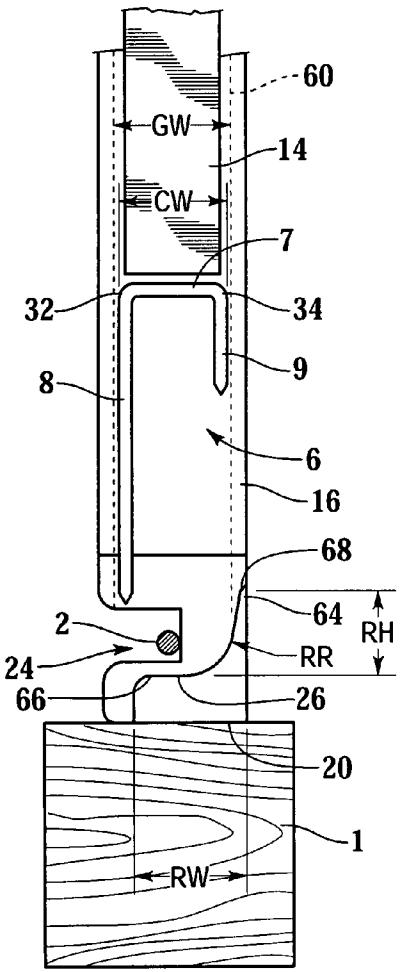
Figure 2:
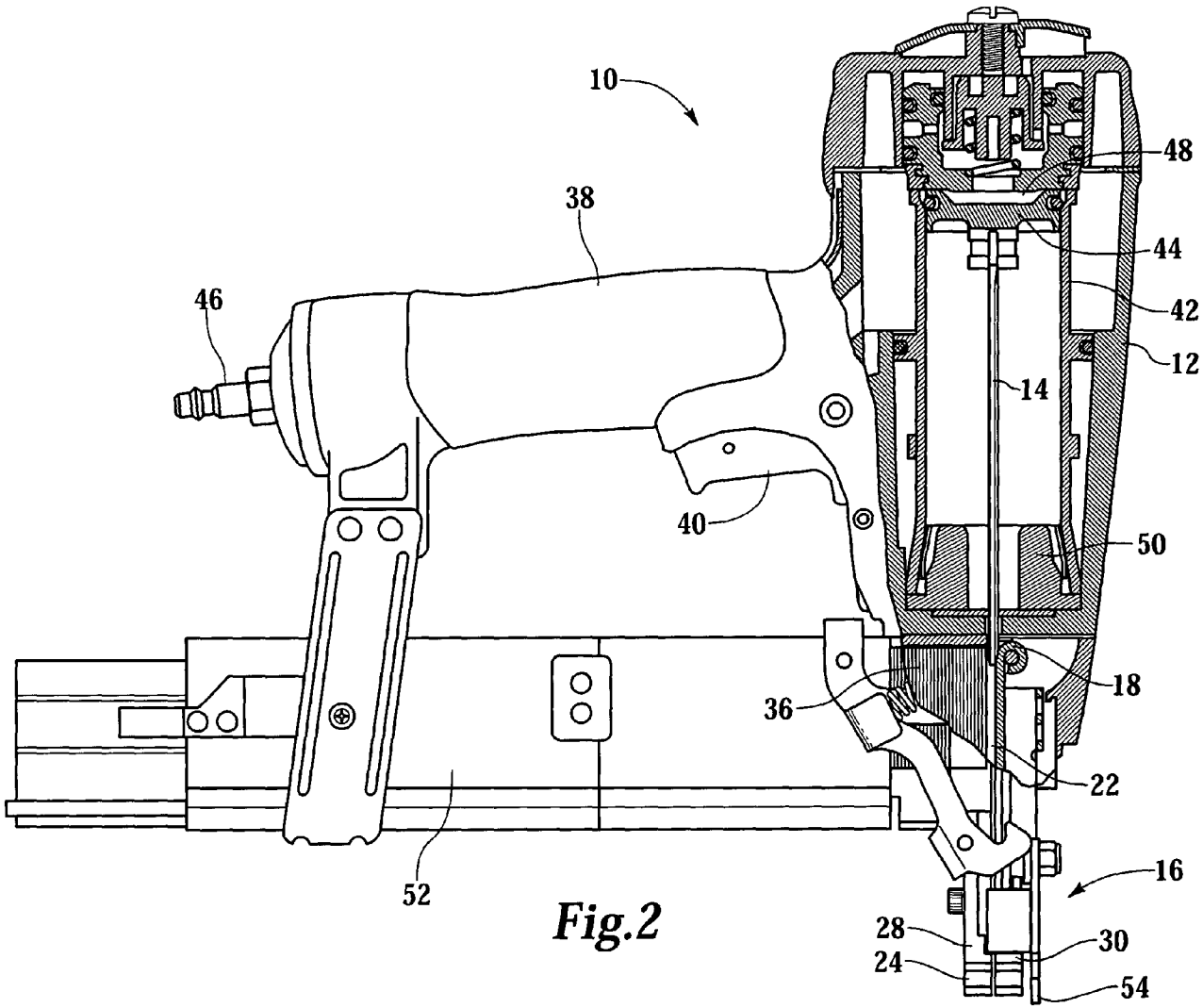
FIG. 2 is a partial side sectional view of the fastener driving tool of the present invention for holding and spacing the wire lath at a predetermined distance from the substrate.

Referring to FIGS. 1A--1D and FIG. 2, a fastener driving tool 10 is shown for holding and spacing an object at a predetermined distance from a substrate 1. Tool 10 is for driving a fastener or clip 6 for holding and spacing an object, such as wire lath 2, at a predetermined distance D from substrate 1, wherein clip 6 includes a bridge portion 7, a long prong 8 extending in a driving direction from bridge portion 7, and a short prong 9 spaced from long prong 8 and extending generally parallel to long prong 8 in the driving direction from bridge portion 7, wherein short prong 9 is substantially shorter than long prong 8. Novel tool 10 includes a housing 12, a driver blade 14 within housing 12 for driving clip 6 in the driving direction, a power source, such as air pressure, for driving driver blade 14, and a nosepiece 16 having a trailing end 18 coupled to housing 12, a substrate contacting end 20, a channel 22 for axially guiding driver blade 14 and fastener 6 in the driving direction toward substrate 1, a slot 24 proximate substrate contacting end 20 laterally extending into channel 22 for receiving wire lath 2, and a curved ramp 26 within channel 22, wherein a portion of ramp 26 is positioned between slot 24 and substrate contacting end 20, wherein curved ramp 26 is generally concave with respect to slot 24, ramp 26 being for interfering with the path of short prong 9 to bend short prong 9 toward long prong 8 to hold wire lath 2 between short prong 9 and bridge portion 7.

Figure 3:
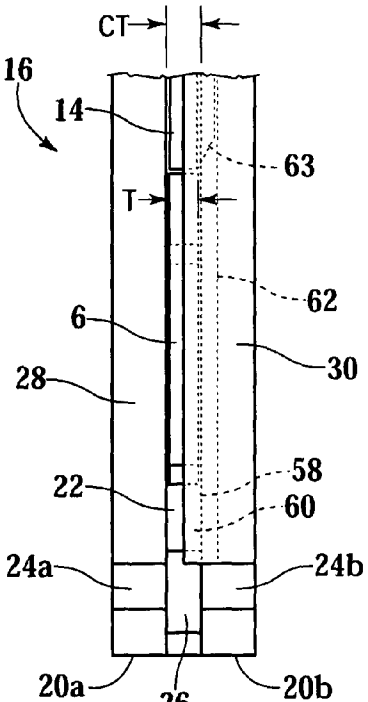
FIG. 3 is a side sectional view of a nosepiece of the fastener driving tool in a close position.
Figure 4:
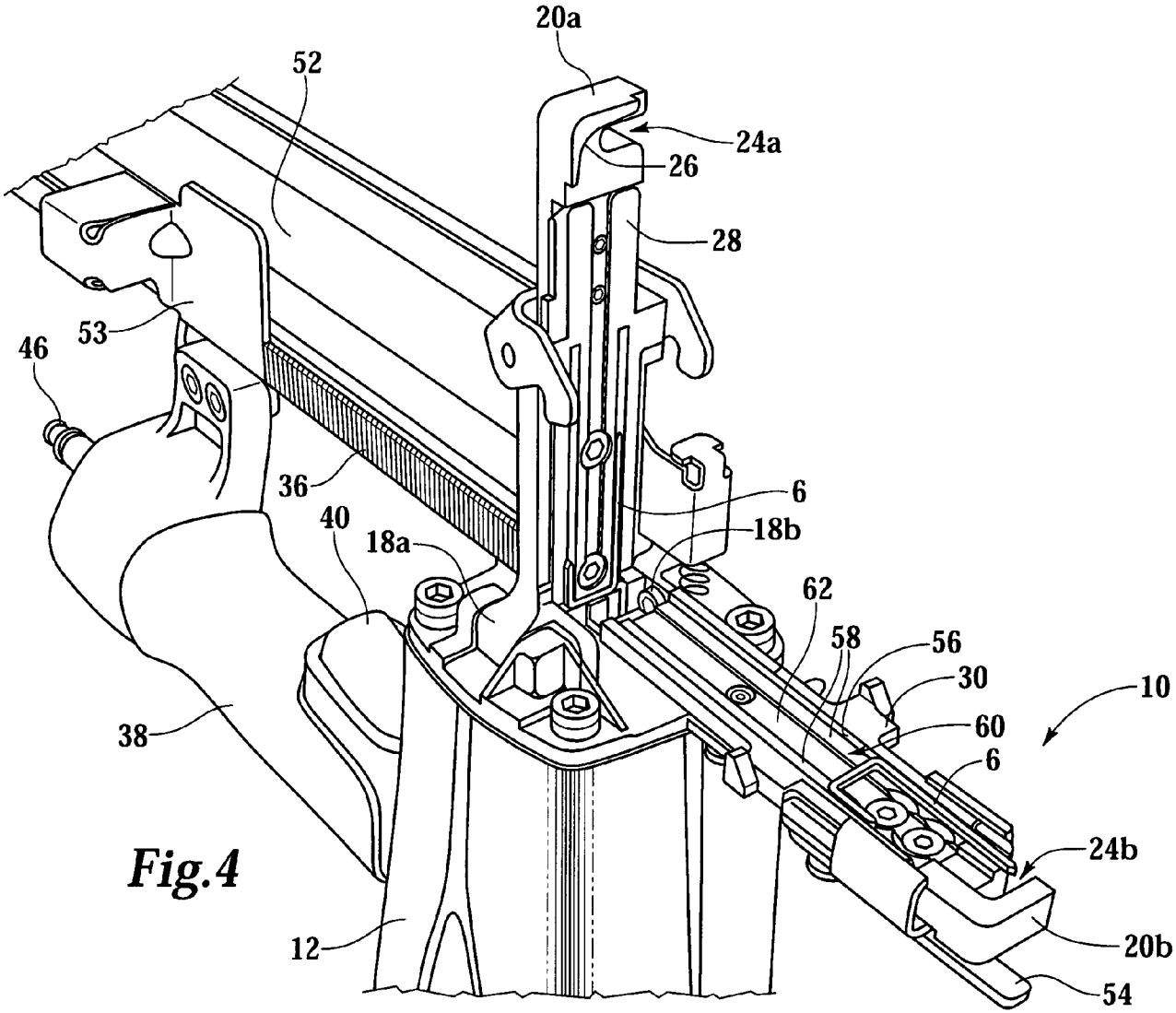
FIG. 4 is a perspective view of the nosepiece of the fastener driving tool in an open position.

In one embodiment, nosepiece 16 includes a stationary piece 28 having a trailing end 18*a* coupled to housing 12 and a substrate contacting end 20*a,* a movable piece 30 having a trailing end 18*b* pivotally coupled to housing 12 proximate trailing end 18*a* of stationary piece 28 and a substrate contacting end 20*b,* wherein movable piece 30 is pivotable between a closed position wherein the movable piece 30 is generally parallel and adjacent to stationary piece 28, see FIGS. 2 and 3, and an open position wherein movable piece 30 is angled open with respect to stationary piece 28, as shown in FIG. 4. Channel 22 is between stationary piece 28 and movable piece 30 when movable piece 30 is in the closed position. Both stationary piece 28 and movable piece 30 include a slot 24*a,* 24*b* proximate substrate contacting ends 20*a,* 20*b* of pieces 28, 30, wherein slots 24*a,* 24*b* laterally extend into channel 22 and slots 24*a,* 24*b* are aligned with one another when movable piece 30 is in the closed position so that slots 24*a,* 24*b* can receive wire lath 2 to position wire lath 2 within channel 22. One of pieces 28, 30 (i.e. stationary piece 28 in FIG. 4) includes curved ramp 26 positioned within channel between slot 24 and substrate contacting end 20 of the one piece 28, 30.

Figure 5:
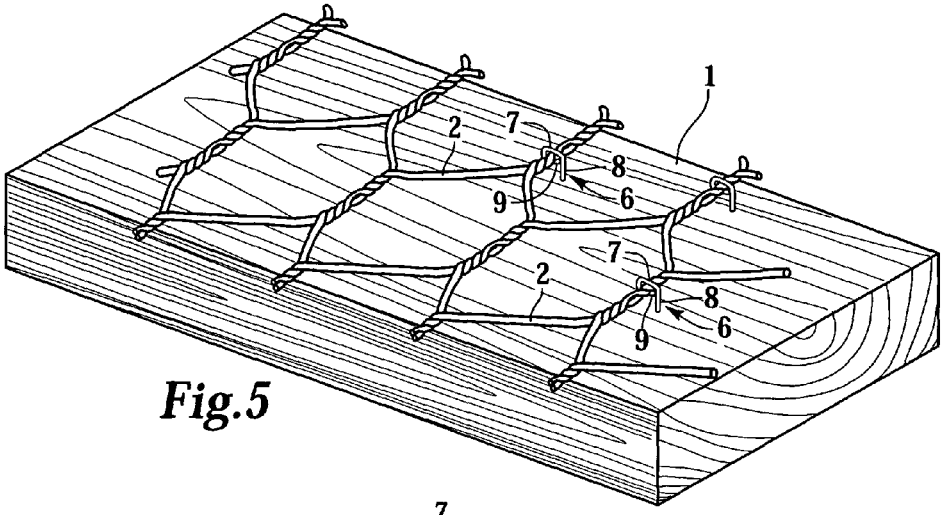
FIG. 5 is a perspective view of fasteners after being installed by the fastener driving tool to hold and space wire lath at a predetermined distance from the substrate.
Figure 6:
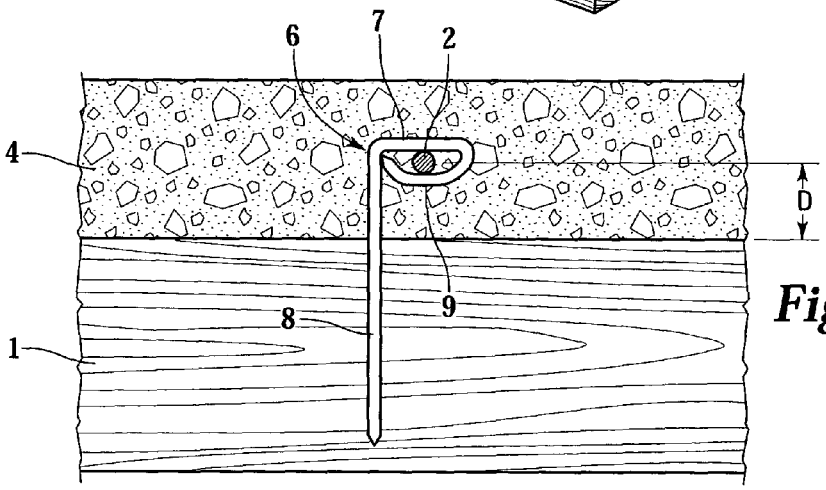
FIG. 6 is a side sectional view of a fastener after being installed by the fastener driving tool, including a stucco layer being reinforced by wire lath.

Turning to FIGS. 5 and 6, tool 10 is used for installing clips 6 for holding and spacing an object, preferably a wire object, at a predetermined distance D from a substrate 1. For example, substrate 1 can be wood, plywood, particle board, oriented strand board (OSB board) or other wooden substrates, and tool 10 can install clip 6 to space a sheet of wire lath 2, such as hexagonal or octagonal chicken wire, from substrate 1 before applying one or more layers of plaster or stucco 4 to substrate 1. In this embodiment, wire lath 2 reinforces stucco 4 to prevent it from breaking away from substrate 1 after stucco 4 has been applied.

It is preferred that wire lath 2 be spaced from substrate 1 by a predetermined distance D so that wire lath 2 will be embedded generally in the middle of stucco 4, as shown in FIG. 6, to most effectively reinforce stucco 4. Clip 6 fastens wire lath 2 to substrate 1, as described below, so that wire lath 2 is spaced from substrate 1 by predetermined distance D. In one embodiment, wire lath 2 is spaced from substrate 1 by a predetermined distance D of between about ⅛ inch and about ⅜ inch, preferably between about ¼ inch and about 5/16 inch.

Clips

Figure 7:
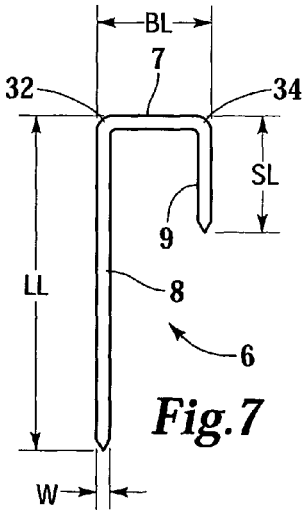
FIG. 7 is a side sectional view of a fastener to be used with the fastener driving tool of the present invention.
Figure 8:
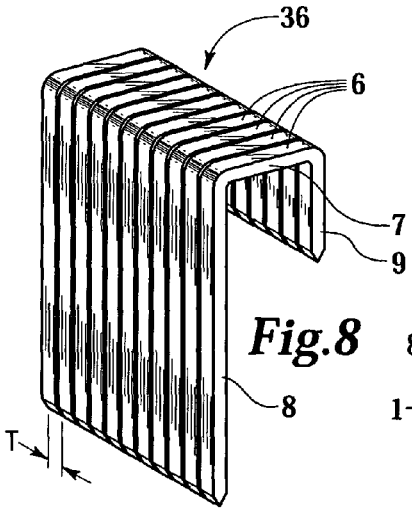
FIG. 8 is a perspective view of a strip of the fasteners to be used with the fastener driving tool of the present invention.

Turning to FIGS. 7 and 8, clip 6 is a generally J shaped wire member having a bridge portion 7 with two ends 32, 34, a long prong 8 extending in the driving direction from one end 32 of bridge portion, and a short prong 9 spaced from long prong 8 at the other end 34 of bridge portion 7 extending generally parallel to long prong 8 in the driving direction, wherein the length SL of short prong 9 is substantially shorter than the length LL of long prong 8.

Preferably, bridge portion 7, long prong 8, and short prong 9 are generally linear segments that are all generally in the same plane, wherein prongs 8, 9 are generally perpendicular to bridge portion 7.

Clip 6 should be made from a material that is strong enough to securely fasten wire lath 2 to substrate 1 and to support wire lath 2 and stucco 4 under normal conditions to prevent stucco 4 from breaking away from substrate 1. Clip 6 can be made from standard steel used in the construction industry, such as standard steel wire used to make staples. Preferably, clip 6 is made from shaped 1018 carbon steel wire that has been flattened so that the wire has a width T of about 0.05 inch and a thickness W of about 1/16 inch.

In one embodiment, short prong length SL is between about 25% and about 45%, preferably about 35% of long prong length LL and between about 75% and about 99%, preferably about 87% of bridge portion length BL. For the application of holding and spacing wire lath 2 from substrate 1, bridge portion 7 can have a length BL, between about 1/4 inch and about 3/4 inch, preferably between about 3/8 inch and about 5/8 inch, still more preferably about 1/2 inch, short prong 9 can have a length SL between about 1/4 inch and about 5/8 inch, preferably between about 3/8 inch and about 1/2 inch, still more preferably about 7/16 inch, and long prong 8 has a length LL of between about 1 inch and about 2 inch, preferably between about 1 1/8 inch and about 1 1/2 inch, still more preferably about 1 1/4 inch.

Turning to FIG. 8, in a preferred embodiment, a plurality of clips 6 are arranged in a strip 36 so that a plurality of clips 6 can easily be fed to tool 10. Strip 36 includes a plurality of clips 6 arranged in a side-by-side array, wherein each clip 6 includes a bridge portion 7, a long prong 8 extending in a driving direction from bridge portion 7, and a short prong 9 spaced from long prong 8 and extending generally parallel to long prong 8 in the driving direction from bridge portion 7, wherein short prong 9 is substantially shorter than long prong 8. Clips 6 are fastened together, such as with an adhesive, in the side-by-side array so that each one of the long prongs 8 is aligned generally in a common first plane and each one of the short prongs 9 are aligned generally in a common second plane so as to form strip 36 of clips 6.

Clip Application Incorporated by Reference

Clips that can be used in tool 10 are disclosed in the commonly assigned, co-pending patent application Ser. No. 10/658,251, filed contemporaneously herewith, the disclosure of which is incorporated herein by reference.

Tool

Turning back to FIG. 2, fastener driving tool 10 of the present invention includes a housing 12 with a handle 38 depending generally from a trailing end of housing 12 for an operator to hold tool 10. A trigger 40 is mounted to handle 38 for actuating tool 10. A cylinder 42 is located within housing 12, with a piston 44 within cylinder 42. A driver blade 14 for driving clips 6 is coupled to piston 44 so that when piston 44 is driven in a driving direction through cylinder 42, so is driver blade 14. In one embodiment, driver blade 14 is made from S-7 steel hardened to a Rockwell C hardness of between about 52 and about 56. A nosepiece 16 is coupled to driving end of housing 12, wherein nosepiece 16 includes a channel 22 for guiding driver blade 14 and clip 6 toward substrate 1.

A power source, such as pneumatic power, gas combustion, or explosive powder is used to drive piston 44 and driver blade 14 in the driving direction toward clip 6. In one embodiment, tool 10 includes an air connection 46 for connecting to a compressed air source (not shown), which feeds into a chamber 48 in the trailing direction of piston 44. When trigger 40 is pulled by an operator, air pressure is increased in chamber 48, which drives piston 44 toward clip 6. Tool 10 can also include a buffer 50 generally at the driving end of cylinder 42 to protect piston 44 and tool 10 from damage due to high speed impact.

Preferably, tool 10 includes a magazine 52 for feeding a strip 36 of clips 6 into channel 22. Strip 36 is fed into magazine 52 of tool 10 so that a first clip is within channel 22. When tool 10 is fired, the first clip is broken away from an adjacent second clip by driver blade 14 so that the first clip is driven toward substrate 1. Tool 10 can also include a follower 53 which biases strip 36 toward channel 22, so that when the first clip is driven, the follower biases the second next clip into channel 22.

Continuing with FIG. 2, tool 10 can also include a drive probe 54 that is operationally connected to a triggering mechanism (not shown), so that tool 10 cannot be fired without drive probe 54 being pushed against substrate 1, forcing drive probe 54 in the trailing direction, enabling actuation of tool 10.

Nosepiece

Turing to FIGS. 3 and 4, Nosepiece 16 guides driver blade 14 toward impact with clip 6, and subsequently guides driver blade 14 and clip 6 toward substrate 1. In one embodiment, nosepiece 16 includes a stationary piece 28 coupled to housing 12 and a movable piece 30 pivotably coupled to housing 12. A channel 22 is located between stationary piece 28 and movable piece 30, as shown in FIG. 3, for guiding driver blade 14 and clip 6. A slot 24*a*, 24*b* is also included near the substrate contacting end 20*a*, 20*b* for receiving wire lath 2 and positioning wire lath 2 within channel 22 so that wire lath 2 will be in the path of clip 6 so that clip 6 will hold and space wire lath 2 at the predetermined distance D from substrate 1. Nosepiece 16 also includes a curved ramp 26 within channel 22, a portion of which is positioned between slot 24*a*, 24*b* and substrate contacting end 20*a*, 20*b*, as shown in FIGS. 1A–1D, for bending short prong 9 to hold wire lath 2.

Stationary piece 28 includes a trailing end 18*a* coupled to housing 12, a substrate contacting end 20*a* and a slot 24*a* near substrate contacting end 20*a* for receiving wire lath 2. In one embodiment, curved ramp 26 is included on stationary piece 28, as shown in FIG. 4, with a portion of curved ramp 26 being positioned between slot 24*a* and substrate contacting end 20*a*. However, curved ramp 26 can be included on movable piece 30 without varying from the scope of the present invention.

Continuing with FIG. 4, movable piece 30 includes a trailing end 18*b* pivotally coupled to housing 12, a substrate contacting end 20*b* and a slot 24*b* near substrate contacting end 20*b* for receiving wire lath 2. In one embodiment, movable piece 30 also includes a pair of ledges 56 and shelves 58 which form a groove 60, wherein groove 60 guides clip 6 so that it remains aligned as clip 6 is driven down channel 22. In one embodiment, movable piece 30 also includes a driver blade groove 62 which guides a rib 63 of driver blade 14. Driver blade groove 62 has a width that is narrower than the width of clip 6 so that clip 6 does not slide into driver blade groove 62.

Nosepiece 16 can be made by steel or other means. In one embodiment, nosepiece 16 is made from 8620 steel that is investment cast made and case hardened to about 0.008 inch to about 0.012 inch with a core hardness of between about 28 Rockwell C and about 35 Rockwell C.

When movable piece 30 is in the closed position, clip 6 is framed within a close clearance on all its lateral sides by nosepiece 16. In the embodiment shown in FIGS. 3 and 4, clip 6 is framed by ledges 56 to the sides, as shown in FIG. 4, by shelves 58 in the back, and by stationary piece 28 in the front, as shown in FIG. 3. The width GW of groove 60 between ledges 56 is only slightly larger than the width CW of clip 6 so that there is a relatively tight clearance between prongs 8, 9 of clip 6 and ledges 56 of groove 60 to guide clip 10 straight down channel 22. Similarly, the thickness CT of channel 22 between shelves 58 on movable piece 30 and stationary piece 28 is slightly larger than the thickness T of clip 6 to prevent clip 6 from wobbling as it is driven. In one embodiment, clip 6 has a width CW of about ½ inch and a thickness T of about 1/16 inch, and groove 60 has a width GW between ledges 56 of between about 17/32 inch and about 9/16 inch and a thickness CT of channel 22 of between about 5/64 inch and about ⅛ inch so that the total clearance on all lateral sides of clip 6 is between about 1/32 inch and about 1/16 inch.

Turning to FIGS. 1A and 1B, ramp 26 extends downwardly toward substrate contacting end 20 and laterally toward long prong 8 so that ramp 26 will interfere with the motion of short prong 9 as clip 6 is driven to bend short prong 9 toward long prong 8. Ramp 26 curves from a short prong end 64 downwardly and inwardly toward a long prong end 66 generally at a radius of curvature RR, wherein long prong end 66 is preferably generally perpendicular to short prong 9 before short prong 9 is bent by ramp 26, as shown in FIG. 1A. In one embodiment, ramp 26 includes a chamfer 68 at short prong end 64 that is angled outwardly slightly from parallel to short prong 9, wherein chamfer 68 helps ensure that the distal end 70 of short prong 9 is fed into ramp 26 so that short prong 9 is bent by ramp 26.

Ramp 26 has a height RH that is slightly larger than the length SL of short prong 9. Ramp 26 has a width RW that is shorter than the width CW of clip 6 and the width GW of groove 60 so that ramp 26 will interfere with the path of short prong 9, but not long prong 8 so that short prong 9 will be bent, but long prong 8 will be driven straight into substrate. Radius of curvature RR of ramp 26 is selected to bend short prong 9 so that wire lath 2 will be held between short prong 9 and bridge portion 7. Radius of curvature RR can be selected so that long prong end 66 is generally normal to short prong end 64 and so that long prong end 66 is also generally normal to prongs 8, 9, as shown in FIG. 1A, or radius of curvature RR can be selected so that long prong end 66 is angled slightly upwardly or slightly downwardly.

In one embodiment, wherein clip 6 has a width CW of about ½ inch and short prong 9 has a length of about 7/16 inch, ramp has a height RH of between about 7/32 inch and about ½ inch, preferably about ⅜ inch, a width RW of between about 3/16 inch and about 1 inch, preferably about 17/32 inch, and a radius of curvature RR of about ¼ inch.

Turning to FIG. 4, slots 24*a*, 24*b* are positioned in the trailing direction of long prong end 66 of ramp 26, so that when short prong 9 is bent inwardly by ramp 26, as shown in FIGS. 1A–1D, short prong 9 will bend into wire lath 2, causing wire lath 2 to be held or clamped between short prong 9 and bridge portion 7 at predetermined distance D from substrate 1.

Figure 9:
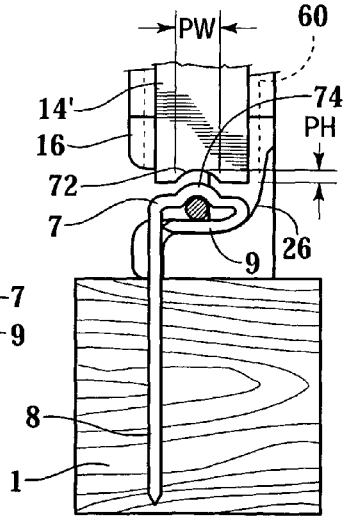
FIG. 9 is a side sectional view of the fastener being installed by a tool having an alternative driver blade.

In one embodiment, shown in FIG. 9, driver blade 14' includes a pocket 72 at the driving end of driver blade 14'. Pocket 72 provides a recess into which bridge portion 7 of clip 6 can be formed into so that an indentation 74 is formed in bridge portion 7 which helps to more securely hold wire lath 2 in place after short prong 9 has been bent by ramp 26. Pocket 72 has a width PW and height PH that compliment wire lath 2 so that indentation is formed between wire lath 2 and driver blade 14' to hold wire lath 2 in place. In the embodiment shown in FIG. 9, pocket 72 is generally curved with a radius of curvature that is approximately twice the radius of wire lath 2. Preferably, pocket 72 is generally centered along the width of driver blade 14', as shown in FIG. 9, so that indentation 74 will be generally centered along the length BL of bridge portion 7. In one embodiment, pocket 72 has a width PW of between about ⅛ inch and about ¼ inch, preferably about 0.15 inch and a height PH of between about 1/16 inch and about 3/16 inch, preferably about 0.1 inch.

Method of Holding and Spacing an Object

The method of holding and spacing wire lath 2 at the predetermined distance D from substrate 1 comprises the steps of providing clip 6 having a bridge portion 7, a long prong 8 extending in a driving direction from bridge portion 7, a short prong 9 spaced from long prong 8 and extending generally parallel to long prong 8 in the driving direction from bridge portion 7, wherein short prong 9 is substantially shorter than long prong 8, positioning the object to be held and spaced, such as wire lath 2, proximate to substrate 1, driving clip 6 so that long prong 8 is driven into substrate 1 to a predetermined depth and so that wire lath 2 is between prongs 8, 9, bending short prong 9 toward long prong 8, and holding wire lath 2 between short prong 9 and bridge portion 7 so that wire lath 2 is spaced from substrate 1 by the predetermined distance D.

Turning to FIGS. 1A–1D, in one embodiment of the method, the driving step, the bending step and the holding step are all performed by tool 10 at essentially the same time. Additionally, the positioning of the wire lath 2 is accomplished by placing wire lath 2 within slot 24 in nosepiece 16 so that wire lath 2 is within channel 22 in nosepiece 16.

Clip 6 is driven by driver blade 14, driving long prong 8 straight into substrate 1, securely fastening clip 6 to substrate 1. Ramp 26 interferes with the path of short prong 9, as shown in FIGS. 1A–1D, bending short prong 9 inwardly toward long prong 8 for holding or griping wire lath 2 between short prong 9 and bridge portion 7 so that wire lath 2 is held by clip 6.

Because the width RW of ramp 26 is less than the width GW of groove 60, long prong 8 will not encounter ramp 26, but rather will continue to be driven into substrate 1 by driver blade 14, while short prong 9 will collide with ramp 26. As short prong 9 is being bent, long prong 8 is driven to a predetermined depth into substrate 1. The depth which clip 6 is driven into substrate 1 is determined by nosepiece 16. Nosepiece also includes a substrate contacting end 20 that is pressed against substrate 1 before driving clip 6. Ramp 26 is spaced from substrate contacting end 20 by a predetermined distance DN which is approximately equal to the desired spacing distance D of wire lath 2 from substrate 1. The selected distance DN between nosepiece substrate contacting end 20 and ramp 26 determines the position where short prong 9 will be bent in relation to substrate 1, which in turn determines where wire lath 2 will be held relative to substrate 1.

After tool 10 has driven clip 6 into substrate 1, the operator can remove nosepiece 16 from engagement with clip 6 and wire lath 2 by pulling tool 10 so that bridge portion 7, short prong 9, and wire lath 2 can slide out of slot 24. For example, after installing clip 6, the operator can pull tool 10 to the right in FIG. 1D, so that bridge portion 7, short prong 9, and wire lath 2 slide out of slot 24 to the left, with respect to nosepiece 16. As soon as all of clip 6 is clear of nosepiece 16, the operator can pull tool 10 away from substrate 1, and insert another portion of wire lath 2 into slot 24, as shown in FIG. 1A, for holding and spacing wire lath 2 and predetermined distance D from substrate 1.

The fastener driving tool of the present invention provides a means to quickly and securely hold and space an object, such as wire lath, at a predetermined distance from a substrate. The fastener driving tool provides an improvement over prior tools and methods, while still being easy for an operator to use.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A nosepiece for a fastener driving tool for driving fasteners for holding and spacing an object at a predetermined distance from a substrate, said fastener driving tool having a housing, a driver blade within said housing for driving said fasteners, and a power source for driving said driver blade, each of said fasteners including a bridge portion, a first prong extending in a driving direction from said bridge portion, a second prong spaced from said first prong and extending generally parallel thereto in the driving direction from said bridge portion, wherein said second prong is substantially shorter than said first prong, said nosepiece comprising:

a trailing end coupled to said housing of said fastener driving tool;

a substrate contacting end;

a channel for axially guiding said driver blade and said fastener in a driving direction toward said substrate;

a slot proximate said substrate contacting end laterally extending into said channel for receiving said object; and a curved ramp within said channel, wherein a portion of said ramp is positioned between said slot and said substrate contacting end, said ramp being for interfering with the path of said second prong to bend said second prong toward said first prong to hold said object between said second prong and said bridge portion.

2. A nosepiece according to claim 1, wherein said ramp is generally concave with respect to said slot.

3. A fastener driving tool for driving fasteners for holding and spacing an object at a predetermined distance from a substrate, each of said fasteners including a bridge portion, a first prong extending in a driving direction from said bridge portion, a second prong spaced from said first prong and extending generally parallel thereto in the driving direction from said bridge portion, wherein said second prong is substantially shorter than said first prong, said fastener driving tool comprising:

a housing;

a driver blade within said housing for driving said fastener in the driving direction;

a power source for driving said driver blade;

a nosepiece having:

a trailing end coupled to said housing;

a substrate contacting end;

a channel for axially guiding said driver blade and said fastener in the driving direction toward said substrate;

a slot proximate said substrate contacting end laterally extending into said channel for receiving said object; and a curved ramp within said channel, wherein a portion of said ramp is positioned between said slot and said substrate contacting end, said ramp being for interfering with the path of said second prong to bend said second prong toward said first prong to hold said object between said second prong and said bridge portion.

4. A fastener driving tool according to claim 3, wherein said driver blade further comprises a pocket therein at the driving end of said driver blade for forming an indentation in said bridge portion of said fastener.

5. A fastener driving tool for driving fasteners for holding and spacing an object at a predetermined distance from a substrate, each of said fasteners including a bridge portion, a first prong extending in a driving direction from said bridge portion, a second prong spaced from said first prong and extending generally parallel thereto in the driving direction from said bridge portion, wherein said second prong is substantially shorter than said first prong, said fastener driving tool comprising:

a housing;

a driver blade within said housing for driving said fastener in the driving direction;

a power source for driving said driver blade;

a nosepiece having a first piece with a trailing end coupled to said housing and a substrate contacting end a second piece having a trailing end pivotally coupled to said housing proximate to said trailing end of said first piece and a substrate contacting end, wherein said second piece is pivotable between a closed position wherein said second piece is adjacent to said first piece and an open position wherein said second piece is angled with respect to said first piece;

a channel between said first piece and said second piece when said second piece is in the closed position for axially guiding said driver blade and said fastener in the driving direction toward said substrate wherein said first piece and said second piece each include a slot proximate said substrate contacting ends of said pieces laterally extending into said channel, wherein said slots are aligned with one another when said second piece is in said closed position so that said slots form a path for said object wherein one of said pieces includes a curved ramp positioned within said channel, a portion of said ramp being between said slot of said one of said pieces and said substrate contacting end of said one of said pieces, wherein said ramp is concave with respect to said slots for bending said second prong of said fastener toward said first prong to hold said object between said second prong and said bridge portion.

6. A fastener driving tool according to claim 5, wherein said curved ramp is on said first piece.

7. A fastener driving tool according to claim 5, wherein one of said pieces includes a groove with ledges for guiding said fastener in said driving direction.

* * * * *